United States Patent [19]

Solitt et al.

[11] Patent Number: 4,669,729

[45] Date of Patent: Jun. 2, 1987

[54] INSTANT BINGO GAME VERIFICATION SYSTEM

[75] Inventors: Samuel G. Solitt; Nathan R. Light; Jerry Shaw, all of Akron, Ohio

[73] Assignee: S.L.S. Incorporated, Akron, Ohio

[21] Appl. No.: 793,670

[22] Filed: Oct. 31, 1985

Related U.S. Application Data

[63] Continuation-in-part of Ser. No. 685,846, Dec. 24, 1984, abandoned.

[51] Int. Cl.[4] ..... A63F 1/18

[52] U.S. Cl. ..... 273/138 A; 273/139

[58] Field of Search ..... 273/138 A, 269, 237, 273/1 E, 85 G, DIG. 28; 364/410–412

[56] References Cited

U.S. PATENT DOCUMENTS

| | | | |
|---|---|---|---|
| 4,455,025 | 6/1984 | Itkis | 273/269 |
| 4,467,424 | 8/1984 | Hedges et al. | 273/138 A |
| 4,475,157 | 10/1984 | Bolan | 273/237 |

OTHER PUBLICATIONS 50 cents per card, Instant Bingo Card.
The Official Big Hit Payoff Instant Bingo Card.

*Primary Examiner*—Richard C. Pinkham
*Assistant Examiner*—MaryAnn Stoll Lastova
*Attorney, Agent, or Firm*—Reese Taylor

[57] ABSTRACT

A system for verifying instant bingo game winners includes a plurality of printed cards, each carrying machine readable coding indicia and printed payoff information. A verifying apparatus receives the cards and contains reading and sensing apparatus which can verify the genuineness of the card, determine whether it is a winning card and, in some instances, determine the winning category. The results of the reading and sensing by the verifying apparatus are visually displayed in a format corresponding to that of the cards and the verifying apparatus also has the capability of voiding or cancelling the cards to prevent reuse and embossing the cards with the relevant information as dictated by the coded indicia.

8 Claims, 10 Drawing Figures

INSTANT BINGO GAME VERIFICATION SYSTEM

RELATED PATENT APPLICATIONS

This application is a continuation-in-part of Applicants' earlier filed and copending application, Ser. No. 685,846, filed Dec. 24, 1984, now abandoned, entitled Game Verification System.

BACKGROUND OF THE INVENTION

This invention relates, in general, to a system and apparatus for verifying the winners of various games and relates, in particular, to a system for verifying the winners of various variations of instant bingo games.

DESCRIPTION OF THE PRIOR ART

Bingo is an old and well known game and, particularly in recent years, has become an important fund raising source for charities, fraternal groups and other similar organizations.

Traditionally, bingo has been played by issuing cards having columns of numbers thereon with letters heading each column. The cardholder is given a number of markers and, as a letter/number combination is called out, the cardholder places a marker on the appropriate square. The process is repeated until a winner is determined.

There are many variations of the method of determining a winning card, such as a full row, a diagonal row, a complete card, etc.

The game has also progressed beyond this level to the point where various modifications have been adopted and various aspects of the game have been automated to some extent. One of these modifications involves the utilization of printed tickets or cards which have peel-off or rub-off material on them so that the purchaser can expose numbers or letters and presumably use these numbers with the traditional bingo card.

A further variation involves the purchase of a ticket or card bearing selected letters or numbers which are reviewed and which, if found to be winners, entitle the holder to advance to a more selective drawing to determine the ultimate winner.

A further variation is a so-called "instant" bingo concept, wherein the purchaser obtains a card and then peels off or rubs off portions thereof to determine whether he has a winning card and, if so, the amount of his winnings.

All of these variations, and indeed the basic game, have found a wide degree of acceptance. However, improvements are constantly being developed and are intended and directed toward enhancing the appeal of the game and the excitement attendant to the playing of the game.

SUMMARY OF THE INVENTION

The present invention involves a system which does not radically modify the playing of the game or its presently known variations. However, the system of the present invention carries the evolutionary process further than in the prior art known to applicants, and includes a certain degree of automation and excitement into the process of identifying winners. The system which is the subject of this application is primarily intended to provide means for verifying both the accuracy of the numbers or indicia on the instant bingo ticket held by the player and also verifying that the ticket is a bona fide, genuine ticket.

Operation of the system involves the sale of tickets or cards to the player, and it is contemplated that the system will accommodate one or more of the variations outlined above so that the system will, in the illustrated form of the invention, be appropriate for several variations.

Each of the tickets which are purchased in connection with the present invention have coded indicia thereon which is machine readable and which will convey information to the electronic apparatus which is part of the system and, ultimately, to the player. It should be noted that whether a player has won or lost and, if a winner, the amount, is predetermined when the card is purchased, since the coded indicia is fixed prior to purchase, and the microprocessor chip is likewise pre-programmed. The present system merely verifies and displays this predetermined result.

Thus, the system includes an electronic and mechanical apparatus into which the tickets can be inserted. The electronic apparatus includes detecting and sensing means which are capable of sensing both the genuineness of the ticket and whether or not the ticket bears coded indicia which designates it as a winner or non-winner.

The sensing means carried by the apparatus are also capable of identifying the amount of the winning ticket in some instances, or a certain designated letter or letters of the ticket in other instances.

Finally, the apparatus is capable of actuating display means which are either visual or audible, or both, to signal that the ticket is in fact a winner and to convey information to the player and spectators as to the nature of the winning amount.

Accordingly, production of an improved system of the character above described becomes the principal object of this invention, with other objects thereof becoming more apparent upon a reading of the following brief specification, considered and interpreted in view of the accompanying drawings.

OF THE DRAWINGS

BRIEF DESCRIPTION OF THE PREFERRED EMBODIMENTS

Figure 1:
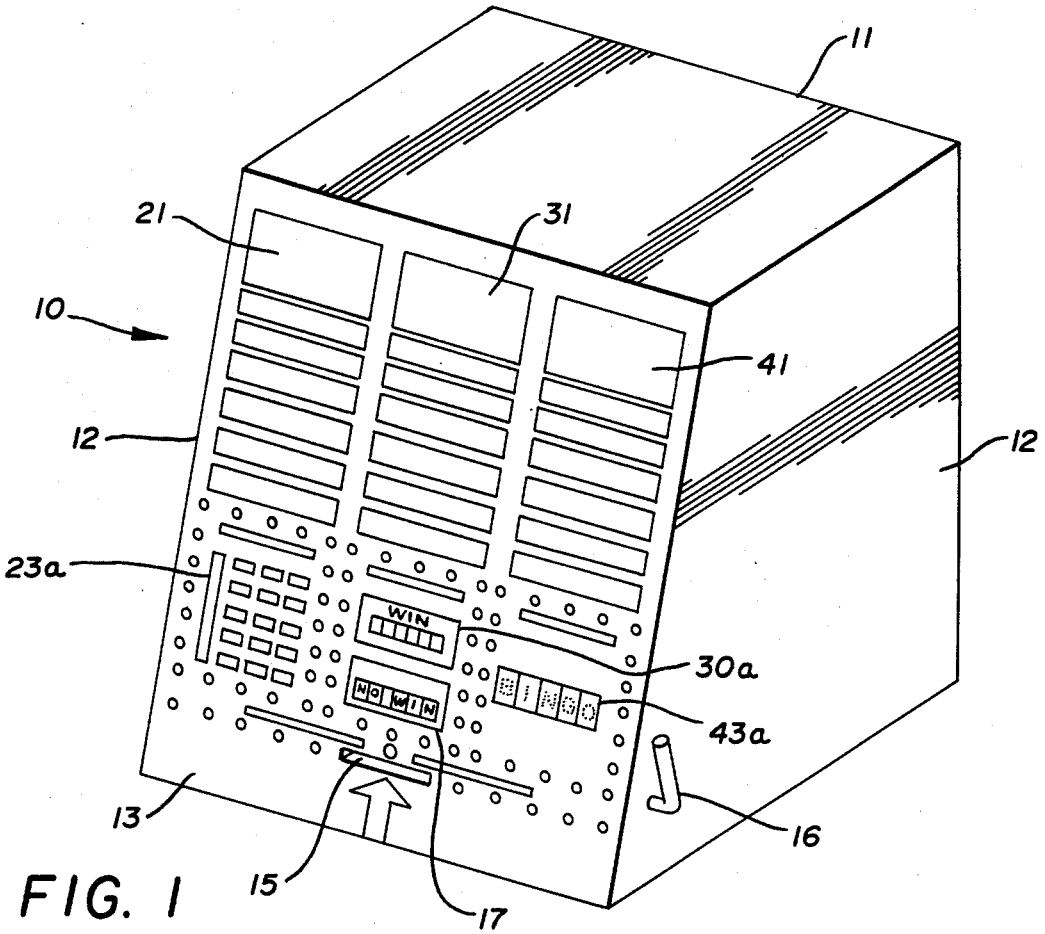
FIG. 1 is a perspective view of a typical apparatus containing the sensing and indicating means of the invention and capable of receipt of the cards used in playing the game.
Figure 2:
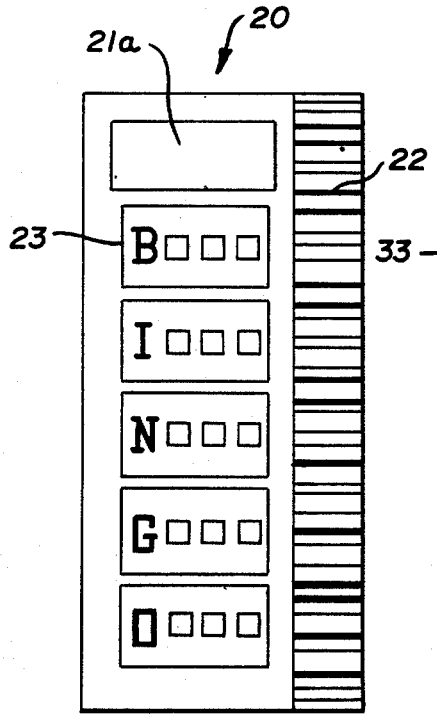
FIGS. 2, 3 and 4 are plan views of typical cards used in playing the games.
Figure 3:
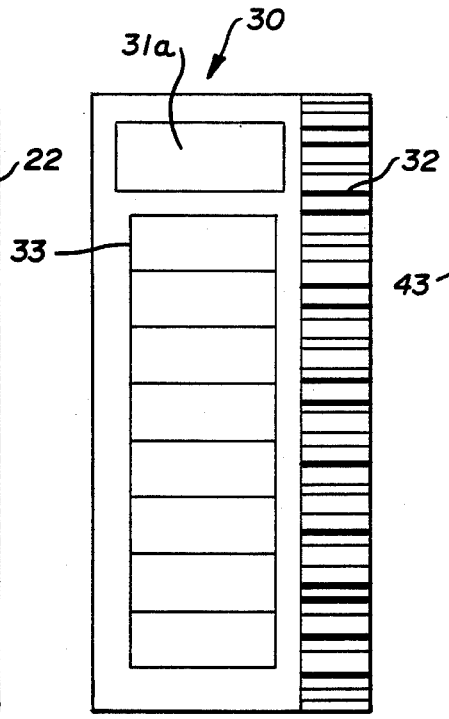
Figure 4:
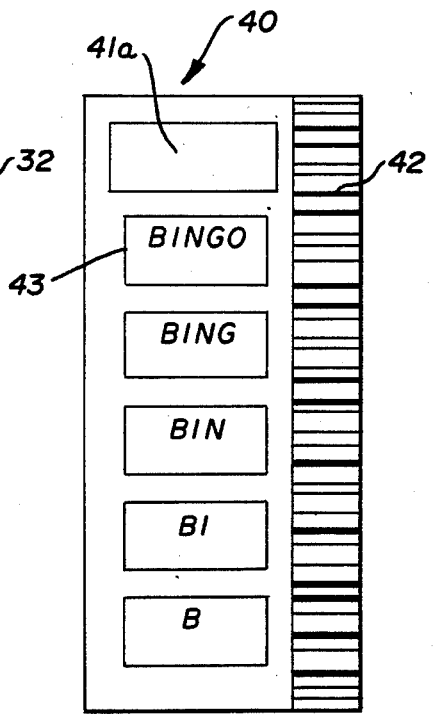

The system of the present invention includes as its principal components a verifying apparatus generally indicated by the numeral 10 of FIG. 1, which includes electronic and mechanical apparatus, and a plurality of individual cards, 20, 30 and 40, examples of which are illustrated in FIGS. 2, 3, and 4 of the drawings.

Figure 5:
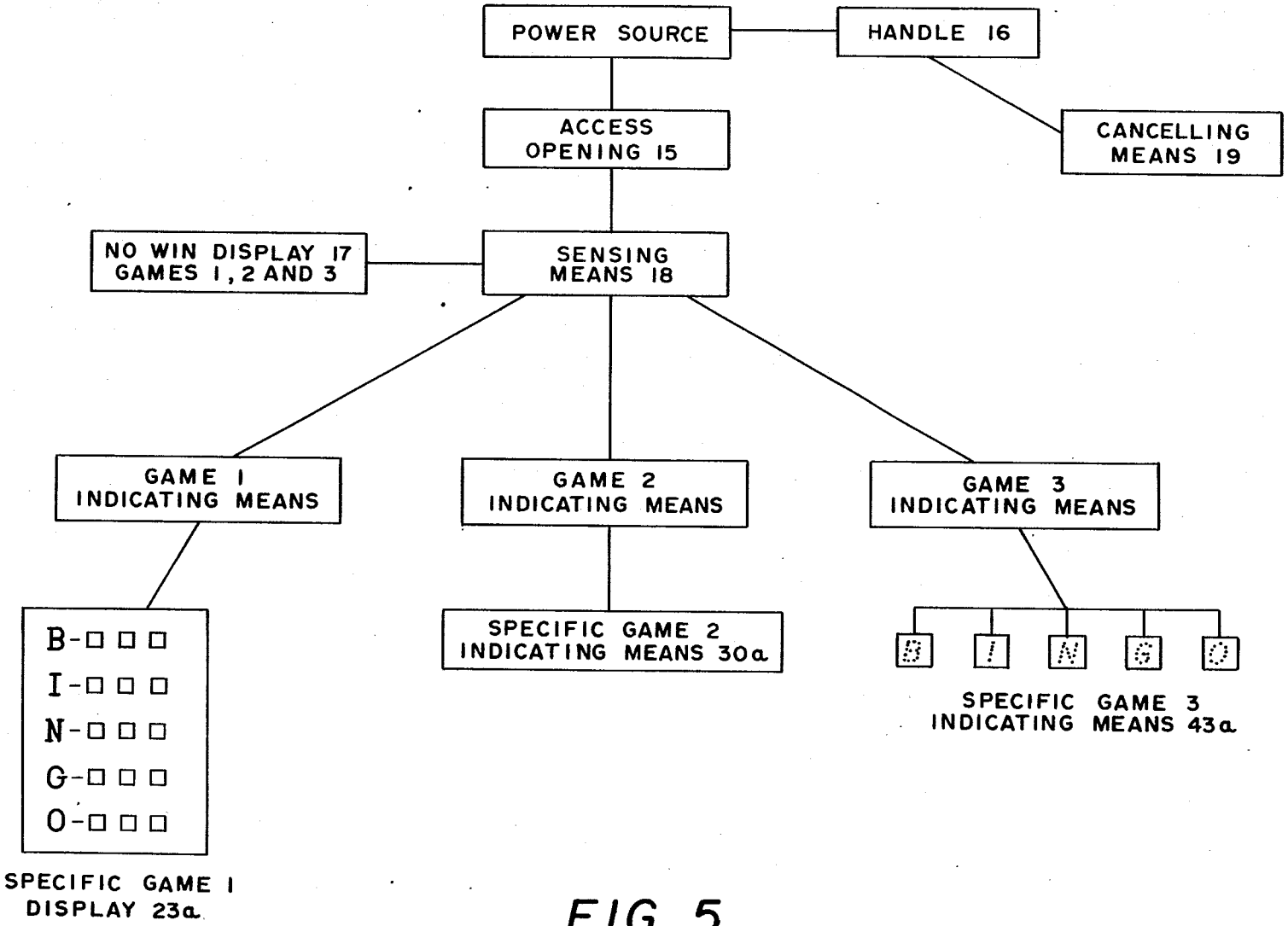
FIG. 5 is a block diagram illustrating in block or schematic form the functions of some of the various components contained in the apparatus illustrated in FIG. 1.
Figure 6:
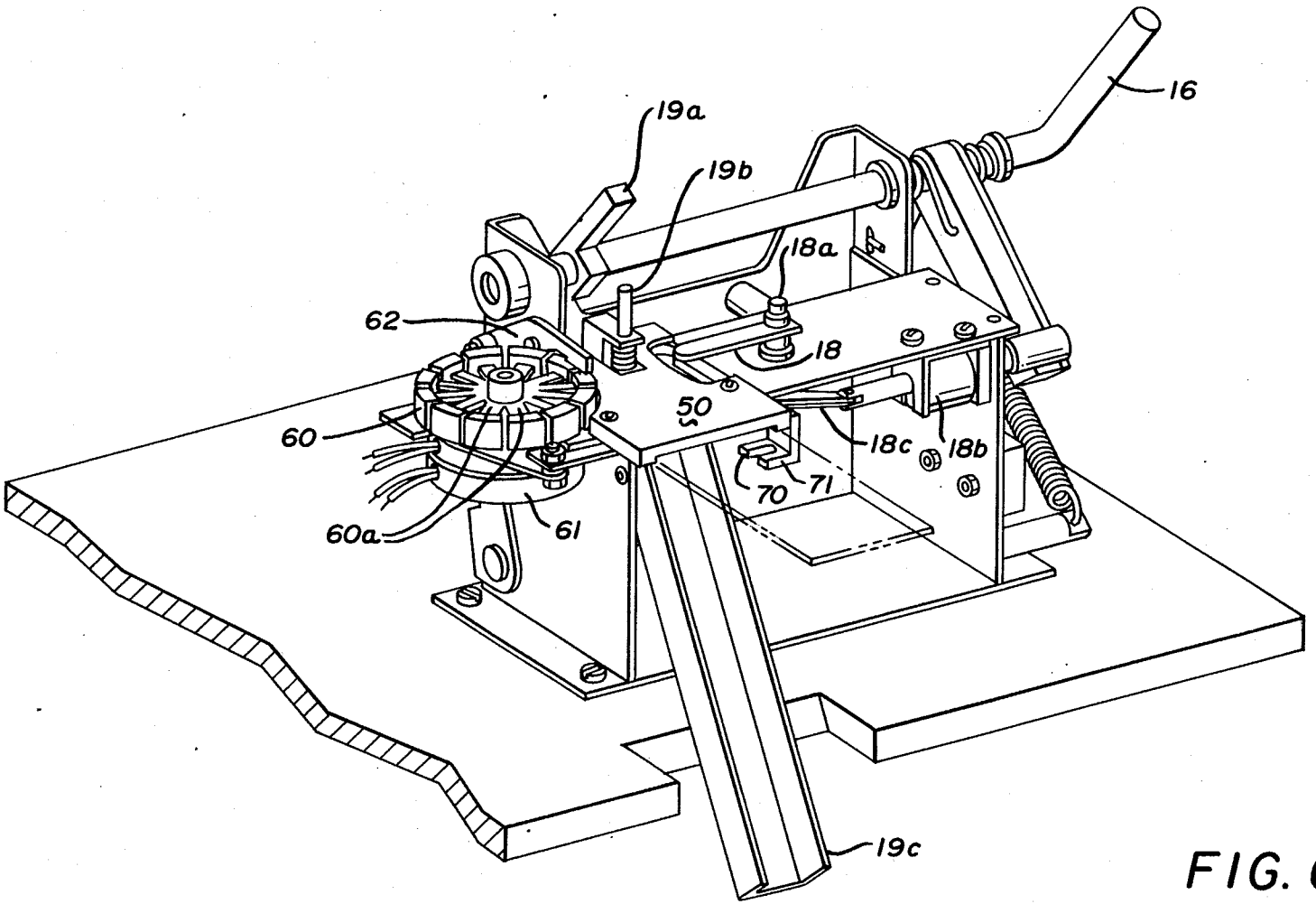
FIG. 6 is a perspective view of the apparatus with the cover removed showing the cancelling, sensing and embossing apparatus.
Figure 7:
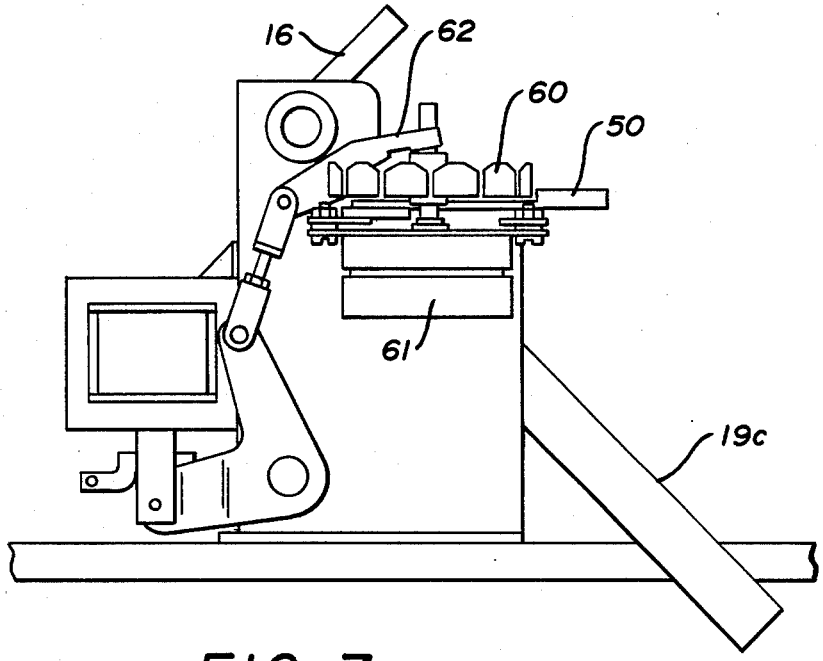
FIG. 7 is a side elevational view taken from the left of FIG. 6.
Figure 8:
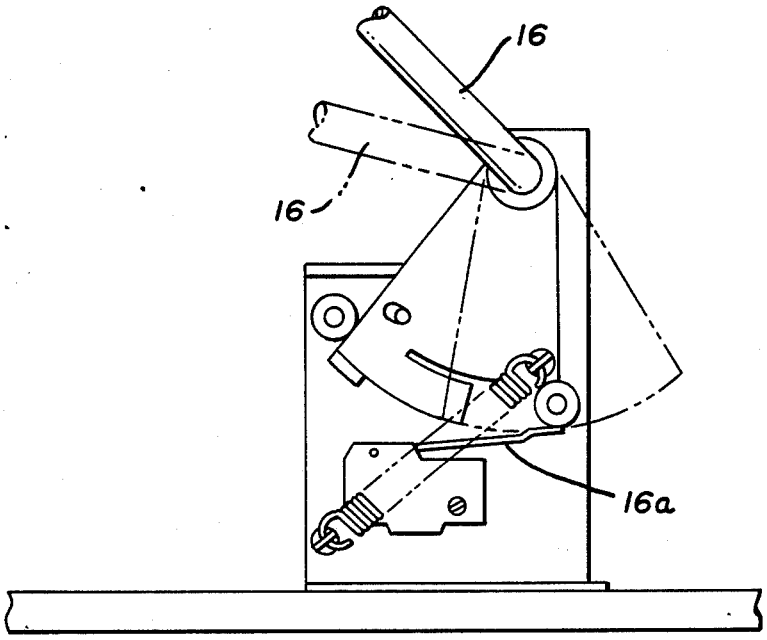
FIG. 8 is a side elevational view taken from the right of FIG. 6.
Figure 9:
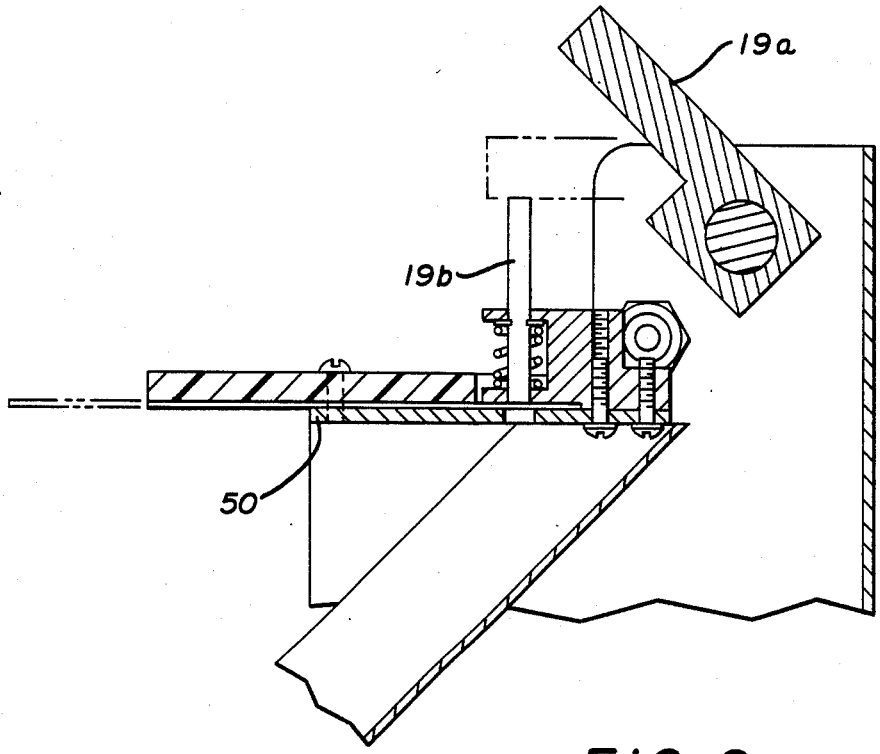
FIG. 9 is a sectional view taken along the line 9-9 of FIG. 6.
Figure 10:
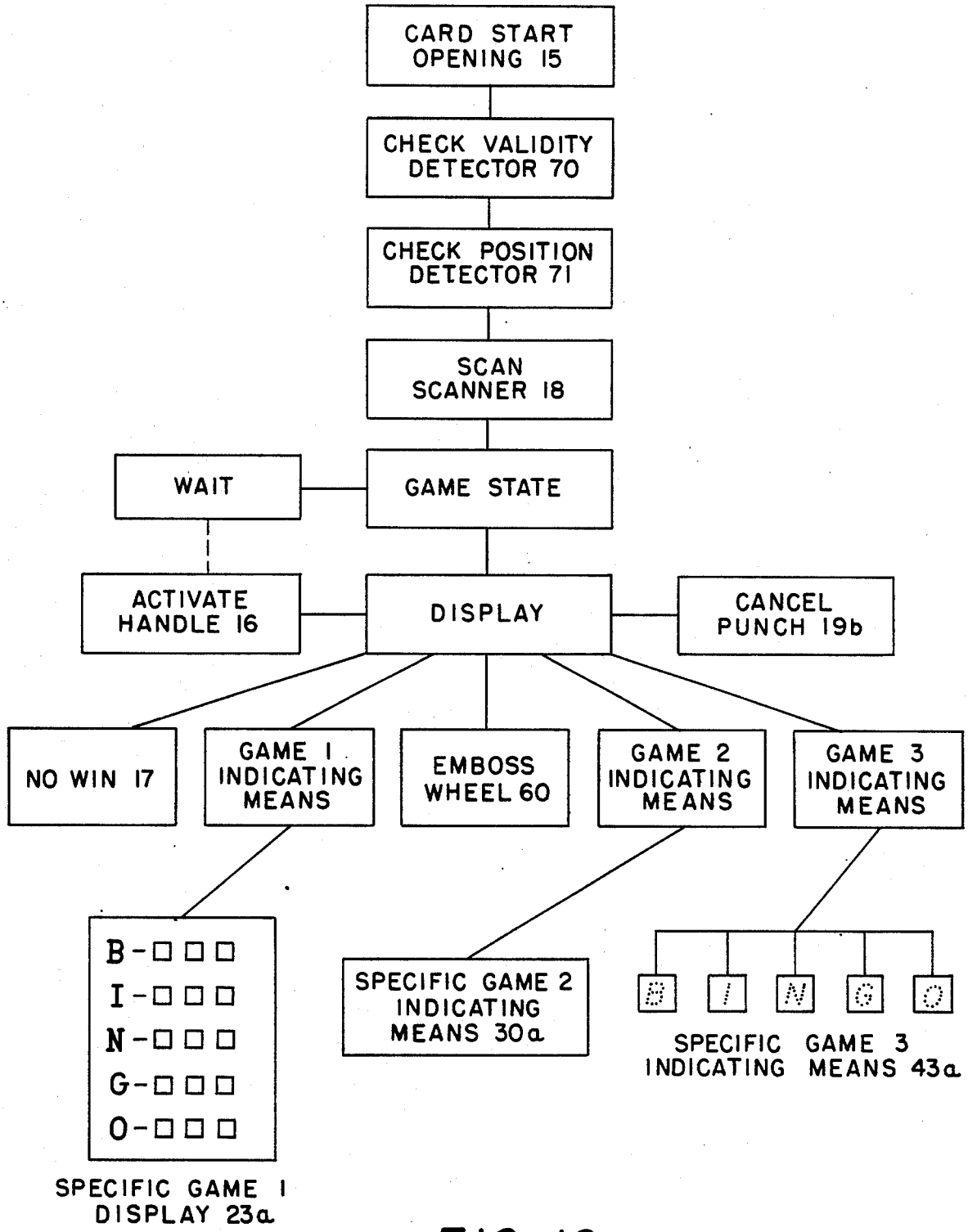
FIG. 10 is an expanded schematic diagram illustrating the functions of the various components.

The verifying apparatus 10 includes a number of electronic components illustrated primarily in schematic form in FIGS. 5 and 10 of the drawings and in some detail in FIGS. 6 through 9. The individual components and the electrical arrangement are believed to be within the capabilities of one having ordinary skill in the electrical arts in view of the requirement characteristics described herein.

As noted, the object of this invention is to provide a system primarily for verifying the tickets in the various modifications of the basic instant bingo game, and also to add visual and audible enhancement to those various games.

Considering then the apparatus 10, it will be noted that the same simply is a cabinet of suitable configuration having a top 11 and opposed sides 12, 12 and a forward face 13. The precise configuration of the cabinet is, of course, a matter of choice and forms no part of the inventive concept disclosed herein.

In the forward face 13 of the verifying apparatus 10, there is an access opening 15. This opening is intended to be of a sufficient size to receive the cards 20, 30 and 40, with it being understood that the cards can be removably inserted into the opening 15 and retrieved therefrom.

Also on the face of the verifying means is informational material such as 21, 31 and 41. Generally speaking, these areas are intended to display the name of the particular bingo game modification involved which, in the form of the invention illustrated, are three in number. To that end, similar identifying information 21*a*, 31*a* and 41*a* is carried on the cards 20, 30 and 40. In this way, the cards are correlated to the display on verifying apparatus 10. That is to say that if one has card 20 for the first game he would primarily refer to the area of front face 13 identified by numeral 21 for information. It is also contemplated that the cards 20, 30 and 40 will be color coded to correspond to a color coding on the apparatus. Thus, for example, the card 20 might be red and the areas 21 and 23*a* which correspond thereto would be red lighted so that the particular game being played by the player will be highlighted.

Also in the face 13 of the verifying apparatus 10 are visual display means 23*a*, 30*a* and 43*a* which will be explained in greater detail below.

Finally, on the face of the printed cards 20, 30 and 40, it will be seen that coded indicia in the form of bar codes 22, 32 and 42 appears, as well as certain printed information as to the nature of the game which can be played with each ticket or card and, in some instances, the possible amount of money to be won, etc. This information is also displayed in the areas 23, 33 and 43.

The bar codes 22, 32 and 42 will include information which will indicate whether the card is genuine, which game variation is involved, whether the card is a winner, and, in the case of the first and third games, the amount of the winning.

The verifying apparatus 10 also has an operating handle 16 projecting from one side 12 which provides for cancelling and embossing the cards and activating the various indicating means after a ticket has been inserted in access opening 15 and the indicia has been read.

Also, the face 13 of verifying apparatus 10 has a no-win display 17 and various other displays which will be described in greater detail below.

Turning of FIGS. 5 and 10 for a brief description of the electronic and mechanical components contained within the verifying apparatus 10 and their functions.

It will first be noted that a main power source can be actuated by a switch, button, or lever (not shown) following which the apparatus is ready for card insertion.

Reference to the apparatus of FIGS. 6 through 9 will also be helpful in reviewing the flow charts of FIGS. 5 and 10.

Thus, immediately behind opening 15, in front face 13, is a plate 50 beneath which a card 20,30 or 40 may be slid. A first detector 70 is mounted adjacent plate 50 to verify the genuineness of the card from the indicia printed thereon. A second detector 71 is also mounted adjacent plate 50 to ascertain that the card is properly positioned, since misalignment could affect operation of sensing means 18.

After the genuineness of the card has been ascertained by detector 70, and the position by detector 71, the second detector 71 then activates scanner or sensing means 18 which is mounted on post 18*a* and which is motor driven by motor 18*b* and linkage 18*c* so that the scanner can move over indicia 22,32 or 42, as the case may be, reading and interpreting that indicia and storing it in a "wait" mode.

At this point the unit is ready for activation of the display and indicating means, the cancelling means, and the embossing means by handle 16.

In operation of the system, the player of the game will purchase one or more of the cards 20, 30 or 40. Of course, the purchaser may purchase various combinations of these cards, but assuming for the sake of explanation that he has purchased one of the cards 20 suitable for playing Game 1 (FIG. 4), he will then insert this card into the access opening 15. At this time, the detectors 70 and 71 will perform the functions previously described and the sensing means or scanner 18 will also operate. At this point the display 21 will also be illuminated to indicate which of the games is involved.

From the indicia 22, the sensing means 18 will have ascertained all the relevant data and be prepared to display that information on command.

The handle 16 is then pulled to trigger switch 16*a* and close a contact to activate the display means 17, 23*a*, 30*a*, 43*a*, which will display the information previously obtained by scanner or sensing means 18.

If the card is a non-winner, the display 17 will be activated and the card may be removed and destroyed. If the card is a winner and assuming still that the card is one of the cards 20 for Game 1, further display or indicating means 23*a* will be activated. In either event cancelling means 19 will punch the card to prevent further use. This is accomplished by bar 19*a* engaging spring-loaded post 19*b* as the handle 16 is pulled from the full to broken line positions of FIGS. 8 and 9 with chute 19*c* being provided for removal of the punched out portion.

Assuming a winning card, with respect to operation of the game connected with the card 20, the printed information 23 on the card designates a series of letters B-I-N-G-O and an increasing amount of winnings associated therewith from, say for example, $5.00 for B to $1,000.00 for O. It will be noted that, essentially, this printed arrangement on card 20 is duplicated at 23*a* on the face 13 of the apparatus 10.

Thus, the visual display 23*a* will indicate, in response to the coding indicia 22, which winning category the ticket 20 is valid for. For example, if the indicia indicates B and B is a $5.00 winner, the display 23*a* will flash the letter B and the amount of $5.00. It is contemplated that the ticket holder would then proceed to a cashier who would verify the ticket on a similar verifying apparatus and make the appropriate payment after embossing as will be described. The reading or sensing means of the cashier's verifying apparatus is basically identical with the apparatus 10, except that it will ignore the cancellation provided by means 19.

Also, as mentioned, before removal from opening 15, the card will be embossed by daisy wheel 60. This wheel is driven by a stepping motor 61 and has a binary code on its spokes 60*a*, 60*a*, which can be read by an optical reader associated therewith (not shown). The wheel 60 is rotated until the predetermined and previously read winning amount is in position. At that point embossing linkage 62 is activated so that the appropriate information is embossed directly on the card.

In the example just given, the letter B would be embossed to provide additional verification for the cashier.

Similar operations are performed with respect to the other game variations.

Thus, for example, if the bingo game modification of Game 2 (FIG. 3) exemplified by the card 30 is employed, the card would be inserted into the access opening 15 and the machine again would sense and verify the card. In this version of the game, it is contemplated that the card merely enables a party to have access to a second card contained in a remotely located hopper, which he would draw out and which card would indicate the amount of the winnings.

Thus, in this version, the verifying apparatus 10 would merely activate indicating means 30*a* indicating a winning card, following which the card 30 would be removed and the player would proceed to the next level. The remaining information 33 on card 30 is merely informational and relates to the winning possibilities.

In any event, the signalling, cancellation, and embossing operations would also be carried out at this station. The daisy wheel 60 would, in this instance, emboss some identifying symbol, letter or number on card 30 to signify that the card was a winner and entitle the player to advance to the next level.

With respect to the variation of the invention designated Game 3 and illustrated in FIG. 4 of the drawings, insertion of the card in opening 15 and actuation of handle 16 would initiate the same verifying, cancellation, embossing and display functions as with Games 1 and 2. In this Game 3, the signalling means would display in area 43*a* which of the letters B-I-N-G-O or which combination of them from B to B-I-N-G-O would be appropriate as prescribed by the coding 42. Here again, as with Game 1, the amount won would be listed on the card 40 and the cardholder would then proceed to a cashier for further verification and payment. Again, the card would also be embossed with the appropriate letter or combination of letters as described with respect to card 20 as in Game 1.

Thus, there has been illustrated and described a system for verifying instant bingo game winners in a non-random way based upon reading of indicia already preprinted on game cards and for displaying those results. In all instances the displays on apparatus 10 correspond to the relevant printed information on the cards.

While a full and complete description of the invention has been set forth in accordance with the dictates of the patent statutes, it should be understood that modifications can be resorted to without departing from the spirit hereof or the scope of the appended claims.

In that regard, it will be noted that a bar code type coding is illustrated on the cards of FIGS. 2, 3 and 4. The sensing means illustrated in FIGS. 5 through 9 of the drawings, of course, would be suitable sensing means for reading a bar code of this type. It is believed apparent that other types of coding and reading or sensing devices could be employed.

Additionally, three specific variations of the basic instant bingo game have been illustrated herein, and it is also believed apparent that additional variations could be employed within the inventive concept of applicants' system, either by increasing the number of games or by substituting for the three games illustrated and even by substituting other words for bingo.

What is claimed is:

1. A system for verifying the winners of at least three different types of instant bingo games which are played with cards which have predetermined winning or non-winning information thereon, comprising:

(A) a plurality of cards, each having machine readable indicia thereon identifying each card as a winning or non-winning card and identifying each card as representing one of first, second and third instant bingo games; and (B) verifying apparatus including (1) an access opening for removable receipt of said cards of said system;

(2) sensing means adjacent said opening for reading said indicia;

(3) first, second and third display means, connected to said sensing means, for instantly indicating winning cards and identifying which of the first, second or third games is represented by each card upon insertion of a card; and (4) fourth display means, connected to said sensing means, for indicating non-winning cards.

2. The system of claim 1 wherein said cards are color coded to identify each game variation; and said display means are correspondingly color coded.

3. The system of claim 1 wherein said system includes audible signalling means.

4. The system of claim 1 wherein cancelling means are provided for cancelling said cards after sensing thereof by physically altering said cards.

5. The system of claim 1 wherein cancelling means are provided for cancelling non-winning cards after sensing thereof.

6. The system of claim 1 wherein said card for said first game also includes indicia designating a winning sum; said sensing and first display means also sensing and displaying the designated winning sum.

7. The system of claim 1 wherein said card for said third game also includes indicia designating a plurality of winning letter combinations; said sensing and third display means also sensing and displaying the designated winning letter combination.

8. The system of claim 1 wherein embossing means are provided for embossing said cards with a repetition of at least some of the information conveyed by said indicia.

* * * * *